US008846136B2

(12) United States Patent
Shoji et al.

(10) Patent No.: US 8,846,136 B2
(45) Date of Patent: Sep. 30, 2014

(54) PRODUCTION METHOD OF RARE EARTH MAGNET

(75) Inventors: Tetsuya Shoji, Toyota (JP); Noritaka Miyamoto, Toyota (JP); Shinya Omura, Aichi-gun (JP); Daisuke Ichigozaki, Toyota (JP); Takeshi Yamamoto, Toyota (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 0 days.

(21) Appl. No.: 13/700,601

(22) PCT Filed: Sep. 13, 2011

(86) PCT No.: PCT/JP2011/071289

§ 371 (c)(1), (2), (4) Date: Nov. 28, 2012

(87) PCT Pub. No.: WO2012/036294

PCT Pub. Date: Mar. 22, 2012

(65) Prior Publication Data

US 2013/0078369 A1 Mar. 28, 2013

(30) Foreign Application Priority Data

Sep. 15, 2010 (JP) ..... 2010-206963
Dec. 10, 2010 (JP) ..... 2010-275992

(51) Int. Cl.

| | |
|---|---|
| ***H01F 41/00*** | (2006.01) |
| ***H01F 41/02*** | (2006.01) |
| ***C22C 38/00*** | (2006.01) |
| *B22F 3/14* | (2006.01) |
| *H01F 1/057* | (2006.01) |
| *B22F 3/10* | (2006.01) |

(52) U.S. Cl.

CPC ..... *H01F 41/005* (2013.01); *B22F 3/14* (2013.01); *H01F 1/0577* (2013.01); *H01F 41/0273* (2013.01); *H01F 1/0576* (2013.01); *B22F 3/1035* (2013.01); *C22C 38/005* (2013.01); *B22F 3/1028* (2013.01)

USPC ..... 427/127; 427/129; 427/131; 427/132

(58) Field of Classification Search

None

See application file for complete search history.

(56) References Cited

U.S. PATENT DOCUMENTS 4,792,367 A * 12/1988 Lee ..... 148/104
6,319,335 B1 * 11/2001 Hirota et al. ..... 148/302

(Continued)

FOREIGN PATENT DOCUMENTS

JP 2-47815 A 2/1990
JP 7-283016 A 10/1995

(Continued)

OTHER PUBLICATIONS

Matahiro Komuro et al., "Structure and magnetic properties of NdFeB powder surrounded with layer of rare-earth fluorides", Journal of Applied Physics, 2008, 4pgs., vol. 103, 07E142.

Qiongzhen Liu et al., "Increased coercivity in sintered Nd-Fe-B magnets with NdF3 additions and the related grain boundary phase", Scripta Materialia, 2009, pp. 1048-1051, vol. 61.

(Continued)

*Primary Examiner* — Mandy Louie

(74) *Attorney, Agent, or Firm* — Sughrue Mion, PLLC

(57) ABSTRACT

PROBLEM:

To provide a production method of an anisotropic rare earth magnet capable of being enhanced in coercivity without adding a large amount of a rare metal such as Dy and Tb.

MEANS FOR RESOLUTION:

A production method of a rare earth magnet, comprising a step of bringing a compact obtained by applying hot working to impart anisotropy to a sintered body having a rare earth magnet composition into contact with a low-melting-point alloy melt containing a rare earth element.

13 Claims, 5 Drawing Sheets

(56) References Cited

U.S. PATENT DOCUMENTS

| | | | | |
|---|---|---|---|---|
| 2008/0223489 | A1* | 9/2008 | Nagata et al. | 148/101 |
| 2010/0003156 | A1 | 1/2010 | Suzuki et al. | |

FOREIGN PATENT DOCUMENTS

| | | | | |
|---|---|---|---|---|
| JP | 2693601 | B2 | 12/1997 | |
| JP | 2005209932 | * | 8/2005 | H01F 1/053 |
| JP | 2008-235343 | A | 10/2008 | |
| JP | 2010-114200 | A | 5/2010 | |
| JP | 2010-263172 | A | 11/2010 | |

OTHER PUBLICATIONS

T. Fukugawa et al., "The effect of oxygen on the surface coercivity of Nd-coated Nd-Fe-B sintered magnets", Journal of Applied Physics, 2009, 4 pgs., vol. 105, 07A724.

S. Hirosawa et al., "Recent Efforts Toward Rare-Metal-Free Permanent Magnets in Japan", RERM' 10 Proceedings of the 21st Workshop on Rare-Earth Permanent Magnets and their Applications, 2010 pp. 187-192.

International Search Report for PCT/JP2011/071289 dated Dec. 13, 2011.

* cited by examiner

PRODUCTION METHOD OF RARE EARTH MAGNET

CROSS REFERENCE TO RELATED APPLICATIONS

This application is a National Stage of International Application No. PCT/JP2011/071289 filed Sep. 13, 2011, claiming priority based on Japanese Patent Application Nos. 2010-206963 filed Sep. 15, 2010 and 2010-275992 filed Dec. 12, 2010 the contents of all of which are incorporated herein by reference in their entirety.

TECHNICAL FIELD

The present invention relates to a production method of a rare earth magnet capable of being enhanced in coercivity. More specifically, the present invention relates to a production method of a rare earth magnet capable of being enhanced in coercivity without adding a large amount of a rare metal such as Dy and Tb.

BACKGROUND ART

Magnetic materials are roughly classified as a hard magnetic material and soft magnetic material, and when both materials are compared, a high coercivity is required of the hard magnetic material, whereas high maximum magnetization is required of the soft magnetic material, though the coercivity may be small.

The coercivity characteristic of the hard magnetic material is a property related to the stability of magnet, and as the coercivity increases higher, the magnet can be used at a higher temperature.

One known magnet using a hard magnetic material is an NdFeB-based magnet which can contain a microcrystalline texture. It is also known that a high-coercivity quenched ribbon containing the microcrystalline texture can be improved in the temperature characteristics and thereby improved in the high-temperature coercivity. However, the coercivity of the NdFeB-based magnet containing a microcrystalline texture decreases during sintering at the bulking as well as during orientation control after sintering.

With respect to this NdFeB-based magnet, various proposals have been made so as to improve characteristics such as coercivity and residual magnetic flux density.

For example, in Patent Document 1, a permanent magnet in which an R—Fe—B-based alloy (R is a rare earth element including Y) prepared through melting and quenching is imparted with magnetic anisotropy by plastic working and in which the average crystal grain size is from 0.1 to 0.5 μm and the volume percentage of a crystal grain having a crystal grain size of more than 0.7 μm is less than 20%, is described and it is demonstrated that in the case where the average crystal grain size after plastic working is less than 0.1 μm, anisotropic orientation of crystal grains does not proceed sufficiently. Furthermore, as a specific example of the production method, a case of obtaining a rare earth magnet through thinning by quenching of a molten alloy, cold forming, hot pressing, and anisotropic orientation by plastic working is described.

Also, in Patent Document 2, a production method of a rare earth permanent magnet is described, wherein a sintered body with a composition of Ra-$T_1$b-Bc (wherein R is one element or two or more elements selected from rare earth elements including Y and Sc, $T_1$ is one or two members of Fe and Co, and each of a, b and c represents an atomic percentage) is heat-treated while allowing an alloy powder having a composition of $M_1$d-$M_2$e (wherein each of $M_1$ and $M_2$ is one element or two or more elements selected from Al, Si, C, P, Ti, V, Cr, Mn, Fe, Co, Ni, Cu, Zn, Ga, Ge, Zr, Nb, Mo, Ag, In, Sn, Sb, Hf, Ta, W, Pb and $B_1$, $M_1$ and $M_2$ are different from each other, and each of d and e represents an atomic percentage) and containing 70 vol % or more of an intermetallic compound phase to be present on the surface of the sintered body, at a temperature not more than the sintering temperature of the sintered body in vacuum or in an inert gas and thereby, one element or two or more elements of $M_1$ and $M_2$ contained in the powder are diffused near the grain boundary part inside of the sintered body and/or the grain boundary part in the main phase grain of the sintered body.

RELATED ART

Patent Document

Patent Document 1: Japanese Patent No. 2693601

Patent Document 2: Kokai (Japanese Unexamined Patent Publication) No. 2008-235343

SUMMARY OF THE INVENTION

Problems to be Solved by the Invention

However, a rare earth magnet having a satisfactory coercivity cannot be obtained even by these known techniques.

Accordingly, an object of the present invention is to provide a production method of an anisotropic rare earth magnet capable of being enhanced in the coercivity without adding a large amount of a rare metal such as Dy and Tb.

Means to Solve the Problems

The present invention relates to a production method of a rare earth magnet, comprising a step of bringing a compact (shaped body) obtained by applying hot working to impart anisotropy to a sintered body having a rare earth magnet composition into contact with a low-melting-point alloy melt containing a rare earth element.

Effects of the Invention

According to the present invention, an anisotropic rare earth magnet having an enhanced coercivity can be easily obtained without adding a large amount of a rare metal such as Dy and Tb.

MODE FOR CARRYING OUT THE INVENTION

According to the present invention, an anisotropic rare earth magnet increased in the coercivity can be obtained by a production method of a rare earth magnet, comprising a step of bringing a compact obtained by applying hot working to impart anisotropy to a sintered body having a rare earth magnet composition into contact with a low-melting-point alloy melt containing a rare earth element.

In the description of the present invention, the low-melting-point alloy means that the melting point of the alloy is low compared with the melting point of $Nd_2Fe_{14}B$ phase.

The present invention is described below by referring to FIGS. 1 to 4.

Figure 1:
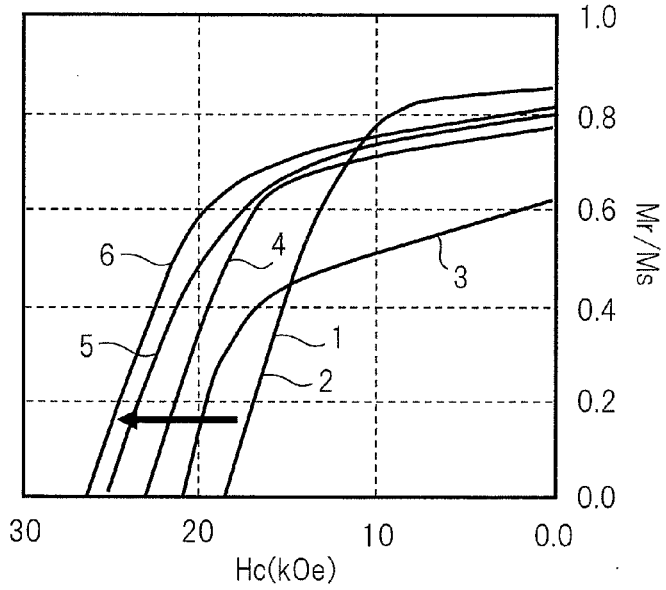
FIG. 1 is a graph showing demagnetization curves of a magnet in an embodiment of the present invention and a magnet out of the scope of the present invention.

As shown in FIG. 1, it is understood that a magnet after a treatment of bringing a compact obtained by applying hot working to impart anisotropy to a sintered body into contact with a low-melting-point alloy melt containing a rare earth element according to an embodiment of the present invention has a large coercivity compared with any of a magnet composed of a compact by hot working, a magnet applied with heat history in place of contact treatment, and a magnet obtained by contact treatment of a sintered body, which are out of the scope of the present invention.

In the description of the present invention, when the degree of deformation (indicated by a compression ratio) by the above-described hot working is large, i.e., when the compression ratio is 10% or more, for example, 20% or more, usually, this is sometimes referred to as strong hot deformation.

Figure 2:
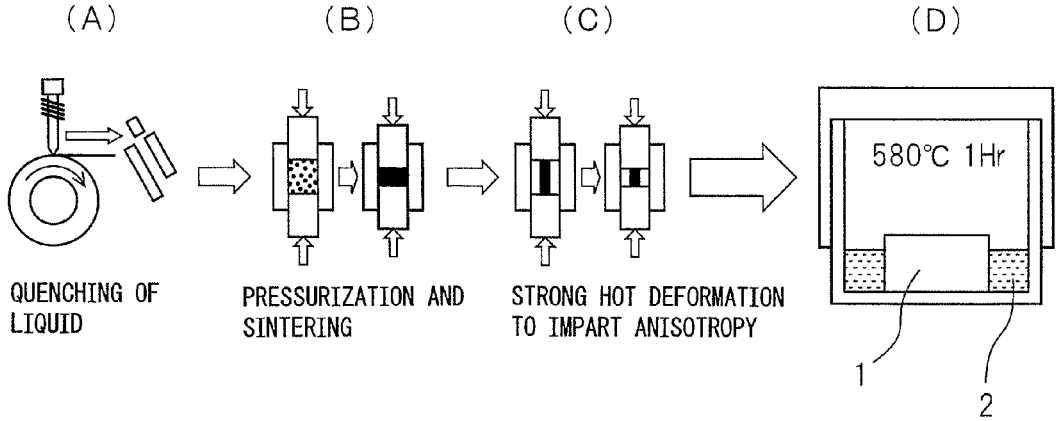
FIG. 2 is a schematic view illustrating the steps in one embodiment of the present invention.

Also, as shown in FIG. 2, in one embodiment of the present invention, the production method may comprise, for example, a step of sintering a quenched thin belt (sometimes referred to as quenched ribbon) obtained from a molten alloy having a composition giving a rare earth magnet, under pressure to obtain a sintered body, a step of applying hot working to impart anisotropy to the sintered body, thereby obtaining a compact, and a step of bringing the compact obtained into contact with a low-melting-point alloy melt containing a rare earth.

Figure 3:
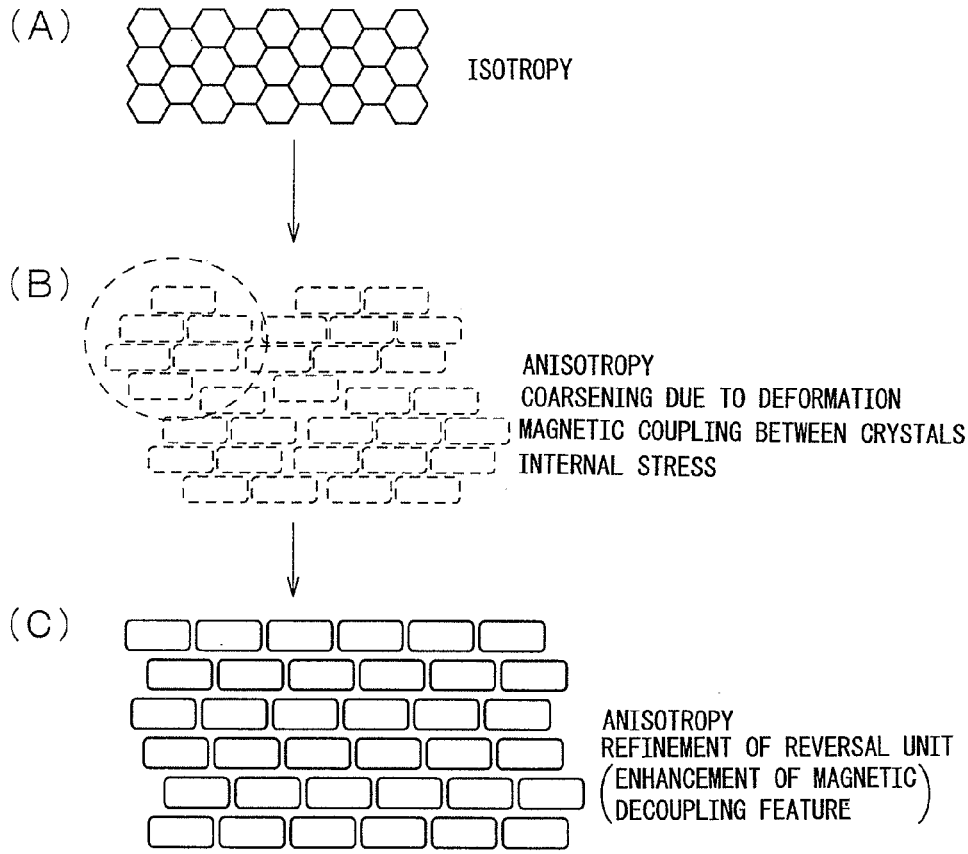
FIG. 3 is a schematic view illustrating nanocrystalline textures of a sintered body in each step according to one embodiment of the present invention, a compact after hot working, and a magnet after the contacting step.

Furthermore, as shown in FIG. 3, in one embodiment of the present invention, the sintered body (A) obtained by sintering a quenched ribbon is isotropic. This sintered body is hot worked to impart anisotropy, and the resulting compact (B) is anisotropic and contains a crystalline nanoparticle, in which deformation by working slightly coarsens the crystal grain and pushes out the grain boundary phase, leading to direct contact of crystal grains with each other and occurrence of magnetic coupling, and moreover, the coercivity decreases because of internal residual strain. This compact is contacted with a low-melting-point alloy melt containing a rare earth element, and the obtained magnet (C) is anisotropic, in which the low-melting-point liquid phase intrudes into the inside of the magnet and penetrates between crystal grains, causing refinement of the magnetization reversal unit for demagnetization and release of the internal stress, as a result, the coercivity is enhanced.

The reason why the rare earth magnet obtained by the method of the present invention has good coercivity is not theoretically clarified, but it is considered that use of a compact obtained by applying hot working to impart anisotropy to a sintered body and contact with a low-melting-point alloy melt containing a rare earth element are combined and thanks to their synergistic effect, that is, the residual strain produced due to hot working is removed by the contact with the melt and the magnetic decoupling feature is enhanced by the sufficient penetration of a rare earth element-containing low-melting-point alloy into the crystal grain boundary, the coercivity of the obtained rare earth magnet is enhanced.

Figure 4:
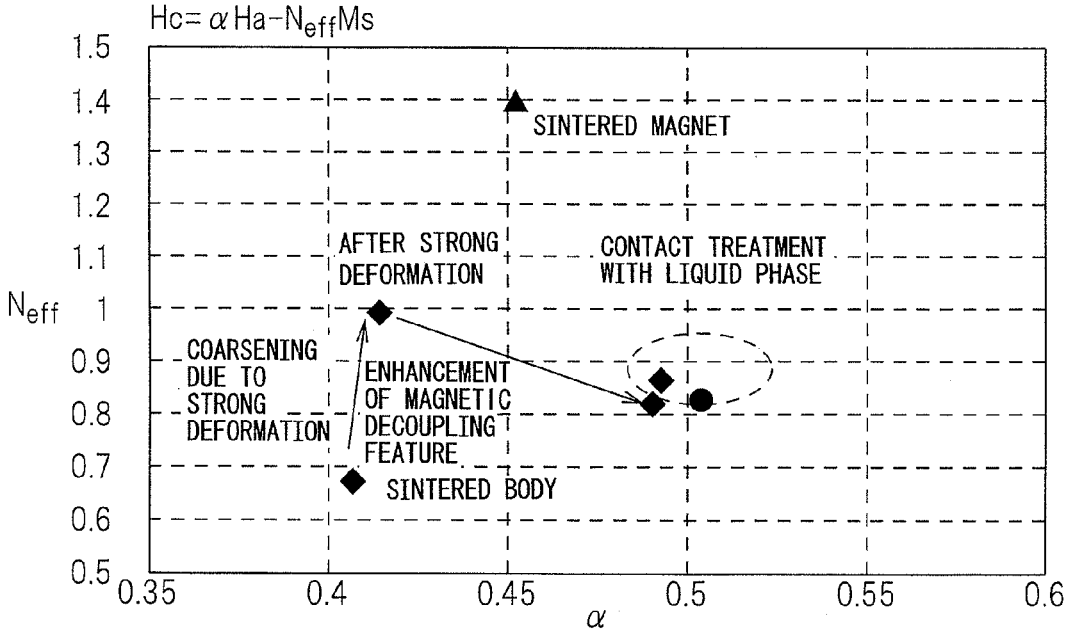
FIG. 4 is a graph schematically showing contributions of a factor attributed to particle diameters of a raw material powder (thin belt) in each step according to one embodiment of the present invention), a sintered body, a compact by hot working, and an anisotropic magnet obtained in the contacting step with a low-melting-point alloy melt, and a factor attributed to decoupling feature between grains.

As shown in FIG. 4, in the sintered body obtained by sintering a quenched ribbon raw material according to one embodiment of the present invention, the $N_{eff}$ value as a factor dependent on the size (mainly attributed to the grain size) of the unit to be reversed at the demagnetization of magnet, which is determined by the method described in detail in Examples later, is small, and the factor $\alpha$ dependent on the degree of magnetic isolation of crystal grain, namely, the magnetic decoupling feature (mainly attributed to the thickness of grain boundary phase), is small. That is, as the grain size of the grain is smaller, the decoupling feature between grains is lower. On the other hand, in the sintered magnet, the decoupling feature between grains is high but, as described above, the $N_{eff}$ value is large, namely, the grain size of the crystal grain is large. In the compact obtained by strong hot deformation of the sintered body after sintering, the decoupling feature between grains is slightly high and the grain size of the crystal grain is large, compared with the sintered body. In the magnet obtained by bringing the compact by strong hot deformation after sintering the raw material powder into contact with a low-melting-point alloy melt containing a rare earth element, as described above, the $N_{eff}$ value is small and $\alpha$ is large. That is, the grain size of the grain is small and the decoupling feature between grains is large. In this way, when the compact obtained by strong hot deformation after sintering is contact-treated with a low-melting-point alloy melt containing a rare earth element, refinement of the unit to be reversed when demagnetizing the magnet and enhancement of the magnetic decoupling feature are achieved, and it is revealed that the coercivity is enhanced by the above-described synergistic effect.

In FIG. 4, $H_c$, $N_{eff}$, $\alpha$, $H_a$ and $M_s$ mean the followings and satisfy the relationship of $H_c=\alpha H_a-N_{eff}M_s$, and it is understood that as $\alpha$ is larger and as Neff is smaller, the coercivity Hc is higher.

$H_c$: Coercivity of magnet $N_{eff}$: Factor attributed to grain size $\alpha$: Factor attributed to decoupling feature between grains $H_a$: Crystal magnetic anisotropy $M_s$: Saturated magnetization The sintered body for use in the present invention is arbitrary as long as a rare earth magnet is obtained. Examples thereof include a compact obtained by producing a quenched thin belt (sometimes referred to as quenched ribbon) by a quenching method from a molten alloy having a rare earth magnet composition, and pressurizing and sintering the resulting quenched thin belt.

The sintered body above is obtained, for example, from a quenched ribbon obtained by quenching a molten alloy having a composition of Nd—Fe—Co—B-M (wherein M is Ti, Zr, Cr, Mn, Nb, V, Mo, W, Ta, Si, Al, Ge, Ga, Cu, Ag or Au, Nd is from more than 12 at % to 35 at %, Nd:B (atomic fraction ratio) is from 1.5:1 to 3:1, Co is from 0 to 12 at %, M is from 0 to 3 at %, and the balance is Fe). Also, an amorphous portion may be contained in the quenched ribbon.

As the method for obtaining a quenched ribbon containing an amorphous portion, a magnetic separation method or a gravity separation method may be used.

In order to obtain a high-coercivity sintered body, the above-described Nd—Fe—Co—B-M composition in an embodiment of the present invention is preferably a composition containing Nd and B in such amounts that Nd or B is richer than the stoichiometric region ($Nd_2Fe_{14}B$). Also, in order to develop high coercivity, the Nd amount is preferably 14 at % or more. Furthermore, in order to develop high coercivity, when the Nd amount is 14 at % or less, it is preferred to enrich B. In addition, for example, a part of excess B may be replaced by another element such as Ga to make Nd—Fe—Co—B—Ga.

For example, in an embodiment of the present invention, with respect to the Nd—Fe—Co—B-M composition, the crystal structure of the NdFeB-based isotropic magnet before hot working can be made to take on a microcrystalline texture by applying hot pressurization/sintering.

Also, in an embodiment of the present invention, the sintered body above is hot worked, for example, at a temperature of 450° C. to less than 800° C., for example, at a temperature of 550 to 725° C., whereby a microcrystalline texture not more than an anisotropic single-domain particle size (<300 nm) can be maintained.

In an embodiment of the present invention, an alloy ingot is produced, for example, by using predetermined amounts of Nd, Fe, Co, B and M in a ratio giving the atomic number ratio above in a melting furnace such as arc melting furnace, and the obtained alloy ingot is treated in a casting apparatus, for example, a roll furnace equipped with a melt reservoir for reserving an alloy melt, a nozzle for supplying the melt, a cooling roll, a motor for cooling roll, a cooler for cooling roll, and the like, whereby the quenched ribbon of Nd—Fe—Co—B-M can be obtained.

In an embodiment of the present invention, the quenched ribbon of Nd—Fe—Co—B-M is sintered, for example, by a method of electrically heating and sintering the quenched ribbon by using an electrically heating and sintering apparatus equipped with a die, a temperature sensor, a control unit, a power supply unit, a heating element, an electrode, a heat insulating material, a metal support, a vacuum chamber and the like.

The sintering above can be performed by electrical heating and sintering, for example, under the conditions of a contact pressure during sintering of 10 to 1,000 MPa, a temperature of 450 to 650° C., a vacuum of $10^{-2}$ MPa or less, and from 1 to 100 minutes.

At the sintering, only the sintering chamber of the sintering machine may be insulated from the outside air to create an inert sintering atmosphere, or the entire system may be surrounded by a housing to create an inert atmosphere.

As for the hot working, a working known as plastic working to impart anisotropy, such as compression working, forward extrusion, backward extrusion and upsetting, may be employed.

The conditions of hot working are, for example, a temperature of 450° C. to less than 800° C., for example, a temperature of 550 to 725° C., an atmospheric pressure or a degree of vacuum of $10^{-5}$ to $10^{-1}$ Pa, and from $10^{-2}$ to 100 seconds.

Also, the hot working may be performed, for example, at a strain rate of 0.01 to 100/s.

The thickness compression ratio of sintered body by the hot working [(thickness of sample before compression−thickness of sample after compression)×100/thickness of sample before compression] (%) may be suitably from 10 to 99%, particularly from 10 to 90%, for example, from 20 to 80%, and, for example, from 25 to 80%.

In the present invention, it is necessary to include a step of bringing the compact obtained in the step above into contact with a low-melting-point alloy metal containing a rare earth element.

The low-melting-point alloy melt containing a rare earth element includes, for example, a melt composed of an alloy having a melting point of less than 700° C., for example, from 475 to 675° C., particularly from 500 to 650° C., i.e., for example, a melt composed of an alloy containing at least one rare earth element selected from the group consisting of La, Ce, Pr and Nd, particularly Nd or Pr, above all, an alloy containing Nd and at least one metal selected from the group consisting of Fe, Co, Ni, Zn, Ga, Al, Au, Ag, In and Cu, particularly an alloy with Al or Cu, more particularly an alloy having a rare earth element content of 50 at % or more, for example, in the case of an alloy with Cu, an alloy where Cu accounts for 50 at % or less, and in the case of an alloy with Al, an alloy where Al accounts for 25 at % or less.

As the alloy, PrCu, NdGa, NdZn, NdFe, NdNi, and MmCu (Mm: misch metal) may be also suitable. In the description of the present invention, the formula representing the kind of alloy indicates a combination of two kinds of elements and does not indicate the compositional ratio.

In the step of bringing the compact into contact with the melt, the temperature of the alloy melt is preferably higher when the contact time with the alloy melt is short, and may be lower when the contact time with the alloy melt is relatively long, and, for example, the step is performed at an alloy melt temperature of 700° C. or less for approximately from 1 minute to less than 3 hours, suitably at a temperature of 580 to 700° C. for approximately from 10 minutes to 3 hours.

By virtue of having a step of bringing the compact into contact with a low-melting-point alloy melt containing a rare earth element, a rare earth magnet enhanced in the coercivity can be obtained.

The rare earth magnet obtained by the present invention generally has a small particle diameter as compared with normal magnets and, for example, may be a magnet where the average particle diameter is less than 200 nm, for example, less than 100 nm, for example, tens of nm, and the crystals are oriented in an aligned manner.

In the method of the present invention, use of a compact obtained by applying hot working to impart anisotropy to the sintered body and contact of the compact with a low-melting-point alloy melt containing a rare earth element must be combined. In either case of a magnet obtained by only hot working but not passing through a step of contact with a low-melting-point alloy melt containing a rare earth element or a magnet obtained by contact-treating a sintered body not subjected to hot working for imparting anisotropy to the sintered body, a magnet enhanced in the coercivity cannot be obtained. Also, in the case of a magnet obtained by applying only heat history without performing the above-described contact treatment, a magnet enhanced in the coercivity cannot be obtained. Furthermore, when a melt is not used but a gas phase diffusion method is employed, exposure to a high temperature for a long time is required so as to achieve diffusion and during exposure to a high temperature for a long time, in the case of a nanocrystalline texture, coarsening of crystal and great deterioration of magnetic characteristics are caused, failing in obtaining an effect of enhancing the characteristics by the diffusion treatment. Diffusion may be achieved also by a sputtering treatment, but enhancement of the characteristics is limited only to just the surface layer and an effect as the entire magnet cannot be expected. In addition, even when an alloy containing a rare earth element is diffused in a raw material powder and the raw material powder is sintered, the characteristics cannot be expected to be enhanced.

The compact for use in the present invention, which is brought into contact with a low-melting-point alloy, is suitably a compact obtained by strong deformation at a compression ratio of 10% or more, for example, from 10 to 99%, for example, from 10 to 90%, for example, from 20 to 80%, and, for example, from 25 to 80%.

According to the method of the present invention, a rare earth magnet capable of being enhanced in the coercivity without adding a large amount of a rare metal such as Dy and Tb can be obtained.

In the foregoing pages, the present invention is described based on the embodiments of the present invention, but the present invention is not limited to these embodiments and can be applied within the scope of claims of the present invention.

EXAMPLES

Working examples of the present invention are describe below.

In the following Examples, magnetic characteristics of a quenched ribbon, a sintered body, a compact by hot working, and a magnet obtained through an immersion step were measured by Vibrating Sample Magnetometer System. Specifically, as for the apparatus, the measurement was performed using a VSM measurement apparatus manufactured by Lake Shorc. Also, the demagnetization curve was measured by a pulse excitation-type magnetic property evaluation apparatus.

Also, the crystal grain sizes in the quenched ribbon and the magnet were measured by an SEM image and a TEM image.

In the Examples, production of a quenched ribbon, pressurization sintering, and strong hot deformation were performed using a single roll furnace, an SPS apparatus, and a pressurization apparatus (with a control unit capable of controlling compression of the thickness to a predetermined thickness from 15 mm) shown in FIG. 2(A), FIG. 2(B) and FIG. 2(C), respectively.

Furthermore, $\alpha$ and $N_{eff}$ can be determined as follows. In the following formula, (T) indicates that each parameter is a function of temperature.

Figure 5:
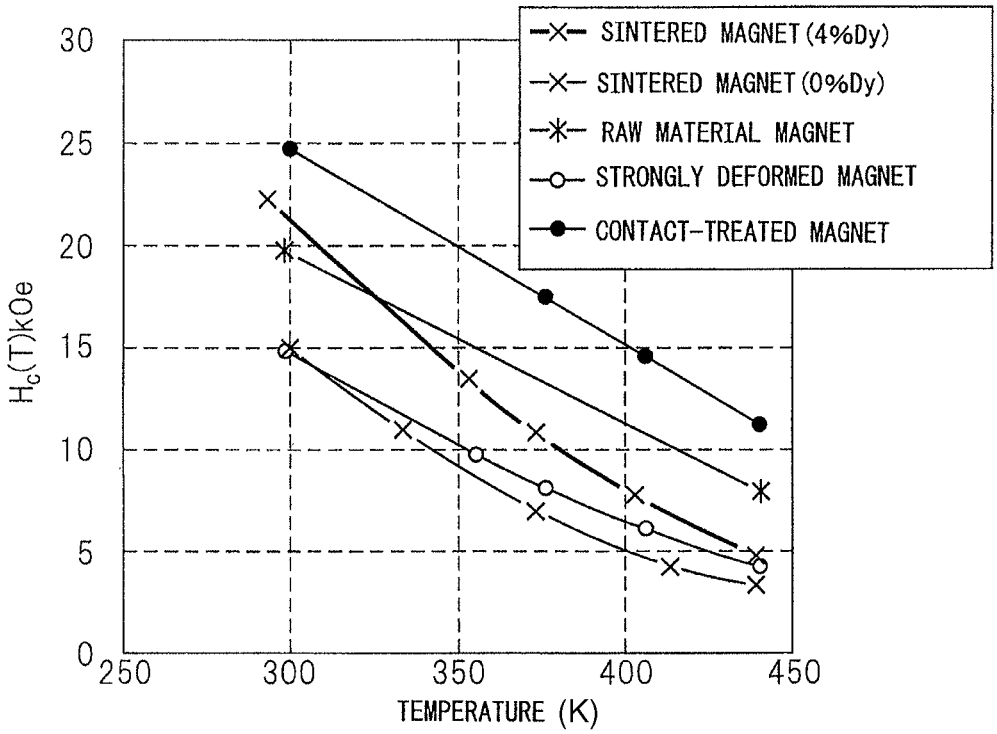
FIG. 5 is a graph comparatively showing temperature dependencies of coercivities of various magnets.
Figure 6:
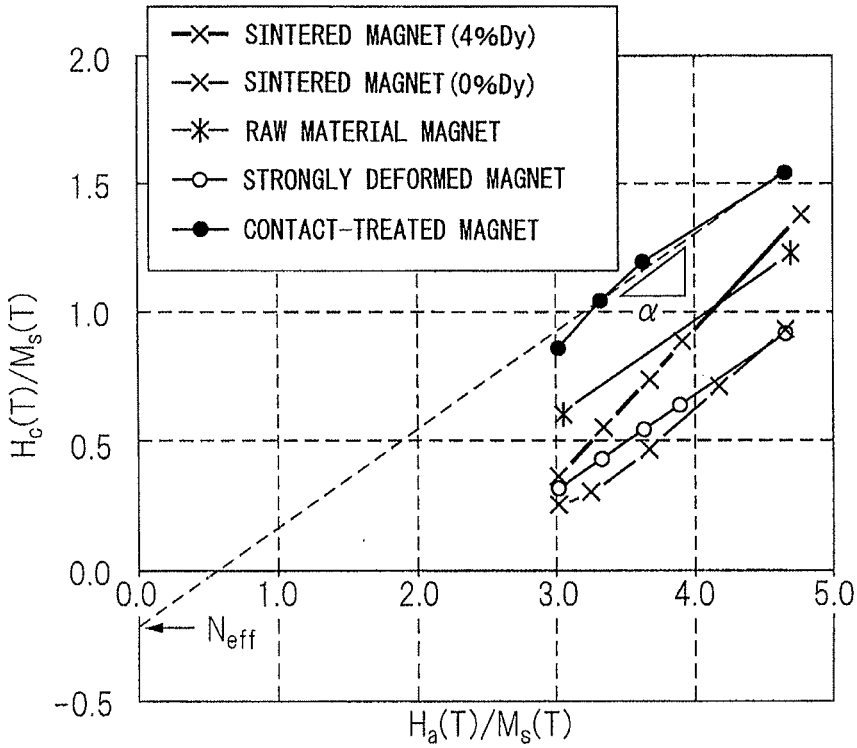
FIG. 6 is a graph comparatively showing relationships between $H_c/M_s$ and $H_a/M_s$ of various magnets.

As described above, since there is a relationship of $H_c(T)=\alpha H_a(T)-N_{eff}M_s(T)$, when both sides are divided by $M_s(T)$, $$H_c(T)/M_s(T)=\alpha H_a(T)/M_s(T)-N_{eff}$$

results, and the formula can be divided into a term dependent on temperature ($H_c(T)/M_s(T)$, $H_a(T)/M_s(T)$) and a constant term $N_{eff}$. Accordingly, in order to determine $\alpha$ and $N_{eff}$, as shown in FIG. 5, the temperature dependency of coercivity is measured and at the same time, as shown in FIG. 6, $H_c(T)/M_s(T)$ is plotted as a function with respect to $H_a(T)/M_s(T)$ from the temperature dependency of saturated magnetization ($M_s$) and the temperature dependency of anisotropic magnetic field ($H_a$). The obtained plots of $H_c(T)/M_s(T)$ vs. $H_a(T)/M_s(T)$ are approximated into a straight line by a least-squares method, and $\alpha$ and $N_{eff}$ can be determined from the gradient and the intercept, respectively.

Incidentally, as for the expression of $H_a$, the following expression approximated by a primary expression with respect to the temperature between 300 and 440 K based on the values in the following publications is used:

$$H_a=-0.24T+146.6 \text{ (}T\text{: absolute temperature)}$$

Also, as for the expression of $M_s$, the following expression approximated by a quadratic expression with respect to the temperature between 300 and 440 based on the values in the following publications is used:

$$M_s=-5.25\times10^{-6}T^2+1.75\times10^{-3}T+1.55 \text{ (}T\text{: absolute temperature)}$$

From the expressions above and the temperature dependency of the measured coercivity ($H_c$), $\alpha$ and $N_{eff}$ are computed.

It has been discovered that due to a combination of strong hot deformation with contact treatment of the present invention, $\alpha$ is enhanced and $N_{eff}$ is decreased. $N_{eff}$ is a parameter dependent on the size (mainly attributed to the grain size) of the unit to be reversed at the demagnetization of magnet, $\alpha$ is an amount dependent on the degree of magnetic isolation (mainly attributed to the thickness of grain boundary phase) of crystal grain, and when $N_{eff}$ is small and $\alpha$ is large, the coercivity is high.

Magnetic Anisotropy:

R. Grossinger et al., *J. Mag. Mater.,* 58 (1986) 55-60

Saturated Magnetization:

M. Sagawa et al., 30*th MMM conf. San Diego, Calif.* (1984)

Example 1

1. Production of Quenched Ribbon

Predetermined amounts of Nd, Fe, Co, B and Ga were weighed in such a ratio that the atomic number ratio of Nd, Fe, Co, B and Ga is 14:76:4:5.5:0.5, and an alloy ingot was produced in an arc melting furnace. Subsequently, the alloy ingot was melted by high frequency in a single roll furnace and sprayed on a copper roll under the following single roll furnace use conditions to produce a quenched ribbon.

Single Roll Furnace Use Conditions:

Spray pressure: 0.4 kg/cm$^3$

Roll speed: from 2,000 to 3,000 rpm

Melting temperature: 1,450° C.

A quenched ribbon with a composition of $Nd_{14}Fe_{76}Co_4B_{5.5}Ga_{0.5}$ containing an amorphous portion was collected by magnetic separation.

The obtained ribbon with a nanoparticle texture was partially sampled and measured for magnetic characteristics by VSM, and the ribbon was confirmed to be hard magnetic. Also, this ribbon with a nanoparticle texture had a crystal grain size of 50 to 200 nm.

The ribbon with a nanoparticle texture was sintered under the following conditions by using a pressurization apparatus: SPS (Spark Discharge Sintering) shown in FIG. 2(B).

Sintering Conditions:

Holding at 600° C./100 MPa for 5 minutes (molding density: almost 100%)

The sintered body obtained was subjected to strong hot deformation under the following conditions by using a pressurization apparatus shown in FIG. 2(C) to impart anisotropy, whereby a compact was obtained.

Strong Hot Deformation Conditions:

60% Compression working (plastic working ratio: 60%) at 650 to 750° C. at a strain rate of 1.0/s The compact obtained was contact-treated by contacting it with an NdCu liquid phase at 580° C. for 1 hour (melting point of NdCu alloy: 520° C., Nd: 70 at %, Cu: 30 at %).

The obtained rare earth magnet was measured for the demagnetization curve, and the results are shown together with other results in FIG. 1. It is seen from FIG. 1 that the coercivity of the magnet of Example 1 was increased by 8 kOe without Dy as compared with Comparative Example 2 of curve 1 where only strong deformation was applied but contact treatment was not performed.

Also, FIG. 4 shows $\alpha$ and $N_{eff}$ determined on the ribbon with nanoparticle texture (raw material powder), the sintered body, the compact by hot working, and the magnet after immersion treatment.

Example 2

A compact was obtained by imparting anisotropy to a sintered body in the same manner as in Example 1 except for performing the strong hot deformation under the following conditions by using a pressurization apparatus shown in FIG. 2(C), and a contact treatment in an NdCu liquid phase at 580° C. for 1 hour was performed in the same manner as in Example 1, except for using the compact obtained above.

Strong Hot Deformation Conditions:

20% Compression working (plastic working ratio: 20%) at 650 to 750° C. at a strain rate of 1.0/s The obtained rare earth magnet was measured for the demagnetization curve, and the results are shown together with other results in FIG. 1.

Example 3

A compact was obtained by imparting anisotropy to a sintered body in the same manner as in Example 1 except for performing the strong hot deformation under the following conditions, and a contact treatment in an NdCu liquid phase at 580° C. for 1 hour was performed in the same manner as in Example 1, except for using the compact obtained above.

Strong Hot Deformation Conditions:

40% Compression working (plastic working ratio: 40%) at 650 to 750° C. at a strain rate of 1.0/s The obtained rare earth magnet was measured for the demagnetization curve, and the results are shown together with other results in FIG. 1.

Comparative Example 1

A magnet was obtained in the same manner as in Example 1 except for adding a heat history of 580° C. for 1 hour in place of the contact treatment in an NdCu liquid phase at 580° C. for 1 hour.

The obtained rare earth magnet was measured for the demagnetization curve, and the results are shown together with other results in FIG. 1.

Comparative Example 2

A compact was obtained by performing production of a quenched ribbon, magnetic separation, sintering and 60% strong hot deformation in the same manner as in Example 1, except for not performing the contact treatment.

The compact obtained was measured for the demagnetization curve, and the results are shown together with other results in FIG. 1.

Comparative Example 3

A sintered body obtained by performing sintering in the same manner as in Example 1 was subjected to a contact treatment in the same manner as in Example 1 without performing strong hot deformation.

The obtained magnet was measured for the demagnetization curve, and the results are shown together with other results in FIG. 1.

It is understood from FIG. 1 that the rare earth magnets obtained in Examples 1 to 3 have a large coercivity compared with any of the magnet composed of a compact by hot working (Comparative Example 2), the magnet obtained by adding only a heat history without performing a contact treatment (Comparative Example 1), and the magnet obtained by contact-treating a sintered body (Comparative Example 3).

Also, when Example 1 is compared with Example 2 and Example 3, the magnet obtained by contact-treating a compact resulting from 60% strong hot deformation has a large coercivity as compared with the magnets obtained by contact-treating a compact resulting from 20% or 40% strong hot deformation, and there is a positive correlation between the degree of deformation (compression ratio) imparted by contact at the time of controlling the orientation in the alloy diffusion treatment and the degree of coercivity enhancement.

Examples 4 to 7

A compact was obtained by using a sintered body obtained in the same manner as in Example 1 and imparting anisotropy in the same manner as in Example 1, except for performing the strong hot deformation under the following conditions by using a pressurization apparatus shown in FIG. 2(C).

Strong Hot Deformation Conditions:

80% Compression working (plastic working ratio: 80%) at 700° C. at a strain rate of 1.0/s The compact obtained was contact-treated by immersing it in an NdAl liquid phase (melting point of NdAl alloy: 640° C., Nd: 85 at %, Al: 15 at %) at 650° C. for 5 minutes (Example 4), 10 minutes (Example 5), 30 minutes (Example 6) or 60 minutes (Example 7).

Figure 7:
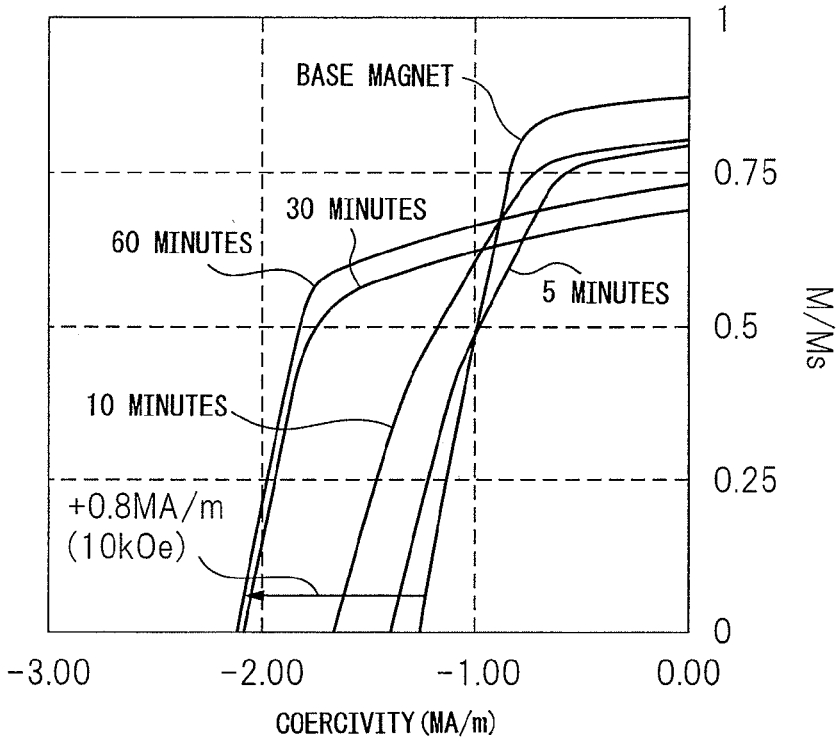
FIG. 7 is a graph comparatively showing magnetic property evaluation results of magnets obtained by changing the contact time in Examples and magnetic property evaluation results of a magnet before contact treatment.

The obtained rare earth magnets were measured for the demagnetization curve, and the results are shown together with the results of Comparative Example 4 in FIG. 7.

Comparative Example 4

A compact as the base magnet was obtained by performing production of a quenched ribbon, magnetic separation, sintering and 80% strong hot deformation in the same manner as in Example 4, except for not performing the contact treatment.

The compact (base magnet) obtained was measured for the demagnetization curve, and the results are shown together with other results in FIG. 7.

It is seen from FIG. 7 that when contacted with an NdAl alloy melt, the time required to complete the contact treatment with a low-melting-point alloy melt is shortened to 30 minutes as compared with the case of using an NdCu alloy melt and also, while contact with an NdCu alloy melt brings an increase in the coercivity by 8 kOe as compared with a compressed body, the increase in coercivity brought by the contact with an NdAl alloy melt is higher and can be 10 kOe.

Furthermore, by selecting Al as the metal element for an alloy forming a liquid phase, the corrosion resistance can be expected to be more enhanced. In addition, also in view of cost, when Cu and Al are compared, Al is advantageous in that the cost is higher.

Examples 8 to 13

A contact treatment was performed by immersing the compact for 60 minutes in the same manner as in Example 2 except for using, in place of the NdCu alloy, MmCu (Mm: misch metal) (Example 8), PrCu (Example 9), NdNi (Example 10), NdGa (Example 11), NdZn (Example 12) or NdFe (Example 13).

Figure 8:
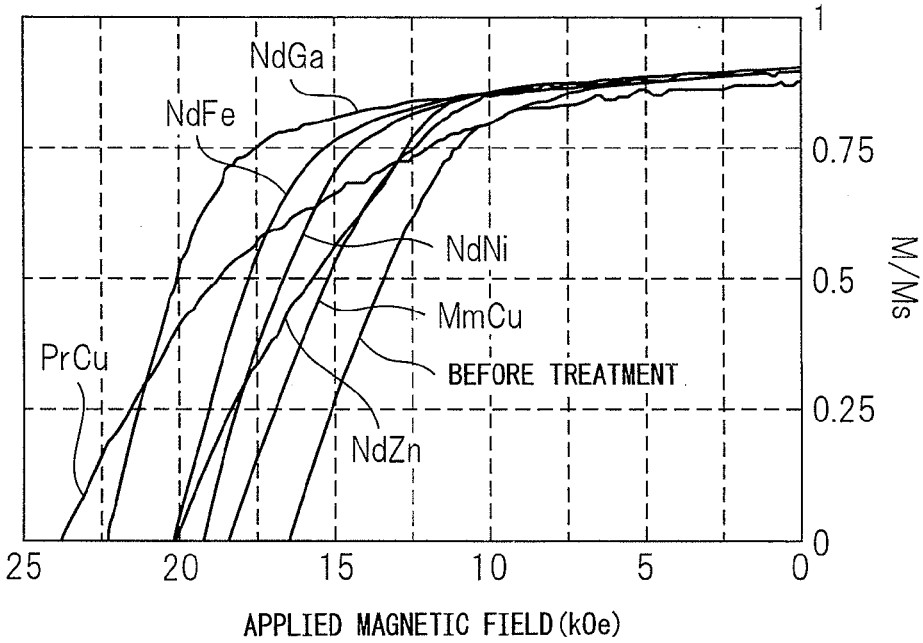
FIG. 8 is a graph comparatively showing magnetic property evaluation results of rare earth magnets obtained by changing the kind of the low-melting-point alloy melt in Examples and magnetic property evaluation results of a magnet before contact treatment.

The obtained rare earth magnets were measured for the demagnetization curve, and the results are shown together with the results of Comparative Example 5 in FIG. 8.

Melting points of alloys used in Examples 8 to 13 are shown in Table 1 below together with the values of NdCu alloy used in Examples 1 to 3 and the NdAl alloy used in Examples 4 to 7.

TABLE 1

| Rare Earth RE | Metal X | Melting Point |
|---|---|---|
| Mm | Cu | 480° C. |
| Pr | Cu | 492° C. |
| Nd | Cu | 520° C. |
| Nd | Al | 640° C. |
| Nd | Ni | 600° C. |
| Nd | Zn | 645° C. |
| Nd | Ga | 651° C. |

The coercivity of the magnet obtained in each Example and the magnetic force of the magnet before contact treatment are shown together below.

Alloy: MmCu (melting point: 480° C.), $H_c$ of magnet after treatment: 17.584 kOe, $H_c$ of magnet before treatment: 15.58 kOe Alloy: PrCu (melting point: 492° C.), $H_c$ of magnet after treatment: 24.014 kOe, $H_c$ of magnet before treatment: 16.32 kOe Alloy: NdCu (melting point: 520° C.), $H_c$ of magnet after treatment: 26.266 kOe, $H_c$ of magnet before treatment: 18.3 kOe Alloy: NdAl (melting point: 640° C.), $H_c$ of magnet after treatment: 26.261 kOe, $H_c$ of the magnet before treatment: 16.3 kOe Alloy: NdNi (melting point: 600° C.), $H_c$ of magnet after treatment: 20.35 kOe, $H_c$ of magnet before treatment: 16.5 kOe Alloy: NdZn (melting point: 645° C.), $H_c$ of magnet after treatment: 20.25 kOe, $H_c$ of magnet before treatment: 16.1 kOe Alloy: NdGa (melting point: 651° C.), $H_c$ of magnet after treatment: 22.35 kOe, $H_c$ of magnet before treatment: 16.3 kOe

Comparative Example 5

A compact was obtained by performing production of a quenched ribbon, magnetic separation, sintering and 80% strong hot deformation in the same manner as in Example 8, except for not performing the contact treatment.

The compact obtained was measured for the demagnetization curve, and the results are shown together with other results in FIG. 8.

Examples 14 and 15

A compact was obtained by using a sintered body and imparting anisotropy in the same manner as in Example 1 except for performing the strong hot deformation under the following conditions by using a pressurization apparatus shown in FIG. 2(C).

Strong Hot Deformation Conditions:

20% Compression working (plastic working ratio: 20%) at 650 to 750° C. at a strain rate of 1.0/s The compact obtained was contact-treated in an NdCu alloy liquid phase at 580° C. (Example 14) or 700° C. (Example 15) for 1 hour. Incidentally, the NdCu alloy used has the same melting point and the same composition as the alloy used in Example 1.

Figure 9:
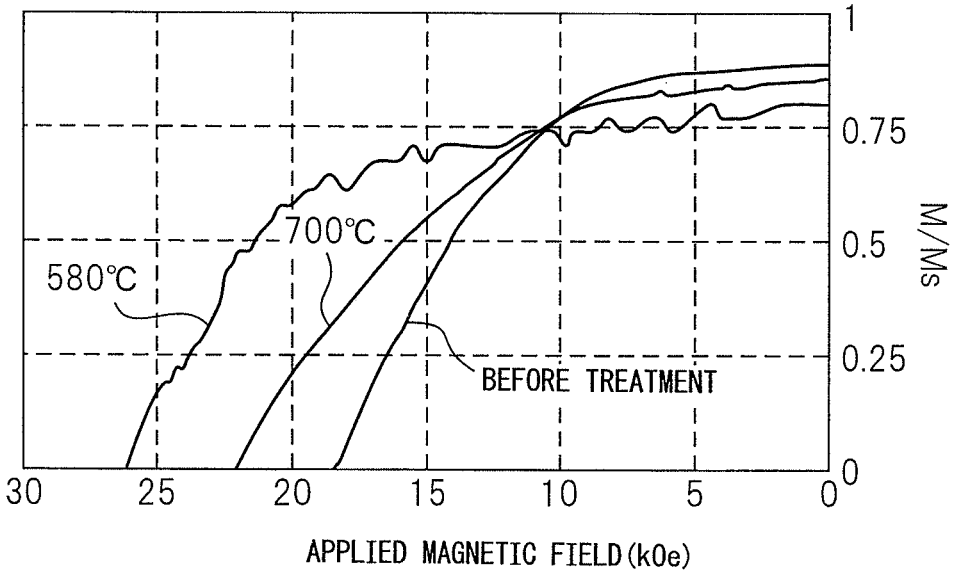
FIG. 9 is a graph comparatively showing magnetic property evaluation results of rare earth magnets obtained by changing the temperature when contacting with the low-melting-point alloy melt in Examples and magnetic property evaluation results of a magnet before contact treatment.

The obtained rare earth magnets were measured for the demagnetization curve, and the results are shown together with other results in FIG. 9.

Comparative Example 6

A compact was obtained by performing production of a quenched ribbon, magnetic separation, sintering and 20% strong hot deformation in the same manner as in Example 14, except for not performing the contact treatment.

The compact obtained was measured for the demagnetization curve, and the results are shown together with other results in FIG. 9.

As apparent from FIG. 9, it is confirmed that the contact treatment by immersion in an NdCu low-melting-point alloy melt can enhance the coercivity at an either temperature of 580° C. or 700° C.

INDUSTRIAL APPLICABILITY

According to the present invention, an anisotropic rare earth magnet with high coercivity can be easily produced.

DESCRIPTION OF NUMERICAL REFERENCES

Curve 1: Only 60% strong hot deformation (no contact treatment) (Comparative Example 2)

Curve 2: Heat history (the same temperature and the same time as in contact treatment) after 60% strong hot deformation (Comparative Example 1)

Curve 3: Contact treatment of sintered body (Comparative Example 3)

Curve 4: Contact treatment after 20% strong hot deformation (Example 2)

Curve 5: Contact treatment after 40% strong hot deformation (Example 3)

Curve 6: Contact treatment after 60% strong hot deformation (Example 1)

1: Compact imparted with anisotropy

2: NdCu Alloy liquid phase

The invention claimed is:

1. A production method of a rare earth magnet, comprising a step of bringing a compact obtained by applying hot working to impart anisotropy to a sintered body having a rare earth magnet composition into contact with a low-melting-point alloy melt containing a rare earth element, wherein said low-melting-point alloy melt containing a rare earth element is composed of an alloy having a melting point of less than 700° C. but not less than 480° C., and wherein the resulting rare earth magnet has a coercivity (Hc) of 17.5 kOe or greater at 300 k.

2. The production method as claimed in claim 1, wherein said low-melting-point alloy melt containing a rare earth element is composed of an alloy of at least one rare earth element selected from the group consisting of La, Ce, Pr and Nd and at least one metal selected from the group consisting of Fe, Co, Ni, Zn, Ga, Al, Au, Ag, In and Cu.

3. The production method as claimed in claim 1, wherein the rare earth element contained in said low-melting-point alloy melt is Nd or Pr.

4. The production method as claimed in claim 1, wherein the rare earth element contained in said low-melting-point alloy melt is Nd.

5. The production method as claimed in claim 1, wherein said low-melting-point alloy melt containing a rare earth element is NdAl.

6. The production method as claimed in claim 1, wherein said low-melting-point alloy melt containing a rare earth element is NdCu.

7. The production method as claimed in claim 1, wherein said sintered body is obtained by shaping a quenched body resulting from quenching of a molten alloy, by pressurization and sintering.

8. The production method as claimed in claim 1, wherein said sintered body is obtained by shaping a quenched body which has a nanocrystalline texture.

9. The production method as claimed in claim 1, wherein said sintered body is obtained by shaping a quenched body which is composed of an amorphous particle.

10. The production method as claimed in claim 1, wherein said hot working to impart anisotropy contains a step of unidirectionally compressing the sintered body at a temperature of 450° C. to less than 800° C.

11. The production method as claimed in claim 1, wherein the contacting step is performed at a temperature of 700° C. or less for 1 minute to less than 3 hours.

12. The production method as claimed in claim 1, wherein the contacting step is performed at a temperature of 580 to 700° C. for 10 minutes to less than 3 hours.

13. The production method as claimed in claim 1, wherein said sintered body has an Nd—Fe—Co—B-M composition wherein M is Ti, Zr, Cr, Mn, Nb, V, Mo, W, Ta, Si, Al, Ge, Ga, Cu, Ag or Au, Nd is from more than 12 at % to 35 at %, Nd:B (atomic fraction ratio) is from 1.5:1 to 3:1, Co is from 0 to 12 at %, M is from 0 to 3 at %, and the balance is Fe.

* * * * *